US006132277A

United States Patent [19]

Tribble et al.

[11] Patent Number: 6,132,277

[45] Date of Patent: Oct. 17, 2000

[54] APPLICATION OF PRECIOUS METAL TO SPARK PLUG ELECTRODE

[75] Inventors: Daniel Lee Tribble, Holland; Michael Earl Garrett; Robert Scott Ingham, both of Toledo; Timothy George Timko, Swanton, all of Ohio

[73] Assignee: Federal-Mogul World Wide, Inc., Southfield, Mich.

[21] Appl. No.: 09/175,437

[22] Filed: Oct. 20, 1998

[51] Int. Cl.[7] ..... H01T 21/02

[52] U.S. Cl. ..... 445/7; 313/141

[58] Field of Search ..... 313/141; 445/7; 123/164 R

[56] References Cited

U.S. PATENT DOCUMENTS

| | | | |
|---|---|---|---|
| 3,868,530 | 2/1975 | Eaton et al. | 313/141 |
| 3,967,149 | 6/1976 | Eaton et al. | 313/141 |
| 4,692,657 | 9/1987 | Grünwald et al. | 313/130 |
| 4,705,486 | 11/1987 | Myers et al. | 445/7 |
| 4,725,254 | 2/1988 | Moore et al. | 445/7 |
| 4,810,220 | 3/1989 | Moore | 445/7 |
| 4,826,462 | 5/1989 | Lenk | 445/7 |
| 4,840,594 | 6/1989 | Moore | 445/7 |
| 5,179,313 | 1/1993 | Eves et al. | 313/141 |
| 5,250,778 | 10/1993 | Chiu et al. | 445/7 |
| 5,347,193 | 9/1994 | Oshima et al. | 313/141 |
| 5,456,624 | 10/1995 | Moore et al. | 445/7 |
| 5,558,575 | 9/1996 | Chiu et al. | 445/7 |
| 5,563,468 | 10/1996 | Abe et al. | 313/141 |
| 5,574,329 | 11/1996 | Kagawa | 313/141 |

*Primary Examiner*—Nimeshkumar D. Patel
*Assistant Examiner*—Todd Reed Hopper
*Attorney, Agent, or Firm*—Fish & Richardson, PC

[57] ABSTRACT

A method of affixing a precious metal to an electrode includes placing a length edge of a generally cylindrical, precious metal wire on an electrode surface and resistance welding the wire to the electrode surface. The precious metal may include platinum.

24 Claims, 5 Drawing Sheets

APPLICATION OF PRECIOUS METAL TO SPARK PLUG ELECTRODE

TECHNICAL FIELD

The invention relates to applying a precious metal wire to the end of a spark plug electrode.

BACKGROUND

A spark plug includes an outer shell and an insulator core. A ground electrode extends from the outer shell and a firing center electrode extends from the insulator core. The electrodes together define a spark plug gap. When the spark plug is installed and operated in the combustion chamber of an engine, a spark is formed in the spark plug gap. The spark ignites a mixture of fuel and air in the combustion chamber.

The quality of the spark affects the ignition of the mixture of fuel and air. The quality of the spark is determined by factors such as the condition of the spark plug gap, the voltage applied across the spark plug gap, and the material composition of the electrodes. A spark plug electrode made of a precious metal such as platinum provides a high quality spark. Platinum and other precious metals, however, are expensive, which limits their use in spark plug electrodes or increases the price of the resulting spark plug.

SUMMARY

A precious metal is affixed to an electrode by placing a generally cylindrical, precious metal wire on an electrode surface and resistance welding the wire to the electrode surface. The wire includes a longitudinal axis and a generally circular cross section. The wire is positioned with a longitudinal edge (a length edge), rather than a circular end, on the electrode surface.

Implementations may include one or more of the following features. For example, a compressive force may be applied to the wire to coin the wire to the electrode surface after welding. The coined wire may be rewelded to the electrode surface. The wire may be cut after resistance welding of the wire to the electrode surface, after placing the wire on the electrode surface, or before placing the wire on the electrode surface. If the wire is cut before placing it on the electrode surface, it is placed on the surface in the form of a column or short segment of wire.

The wire may be resistance welded to the electrode surface using an average electric current of 860 amperes. Rewelding after coining may use an average electric current of 1410 amperes. The wire may be coined to the electrode surface using a compressive force of approximately 400 pounds. The precious metal may include, for example, platinum, gold, iridium, osmium, palladium, rhodium, rhenium, ruthenium, or tungsten, or an alloy of one or more of these metals. The alloy also may include nickel.

In another general aspect, a spark plug having a precious metal electrode surface includes an outer shell, an insulator, a firing electrode, a ground electrode, and a precious metal affixed to an electrode surface. The precious metal is affixed to the electrode surface by resistance welding a cylindrical, precious metal wire to the electrode surface, with a length edge of the wire on the electrode surface.

Embodiments of the spark plug may include the following features. For example, the wire may be coined to the electrode surface and resistance welded. The wire placed on the electrode surface on its length edge may be in the form of a column. The diameter of the column may be approximately the same as the length of the column. The precious metal may include, for example, platinum, gold, iridium, osmium, palladium, rhodium, rhenium, ruthenium, or tungsten, or an alloy of one or more of these metals. The alloy also may include nickel.

Attaching a layer of a precious metal to an electrode in the manner described provides the considerable advantages of reducing the cost of fabricating the column or piece of precious metal that is affixed to the electrode. This permits attachment of an increased amount of precious metal for the same cost as would be incurred to attach a lesser amount of metal using more expensive methods.

Other features and advantages will be apparent from the following description, including the drawings, and from the claims.

DESCRIPTION

Figure 1A:
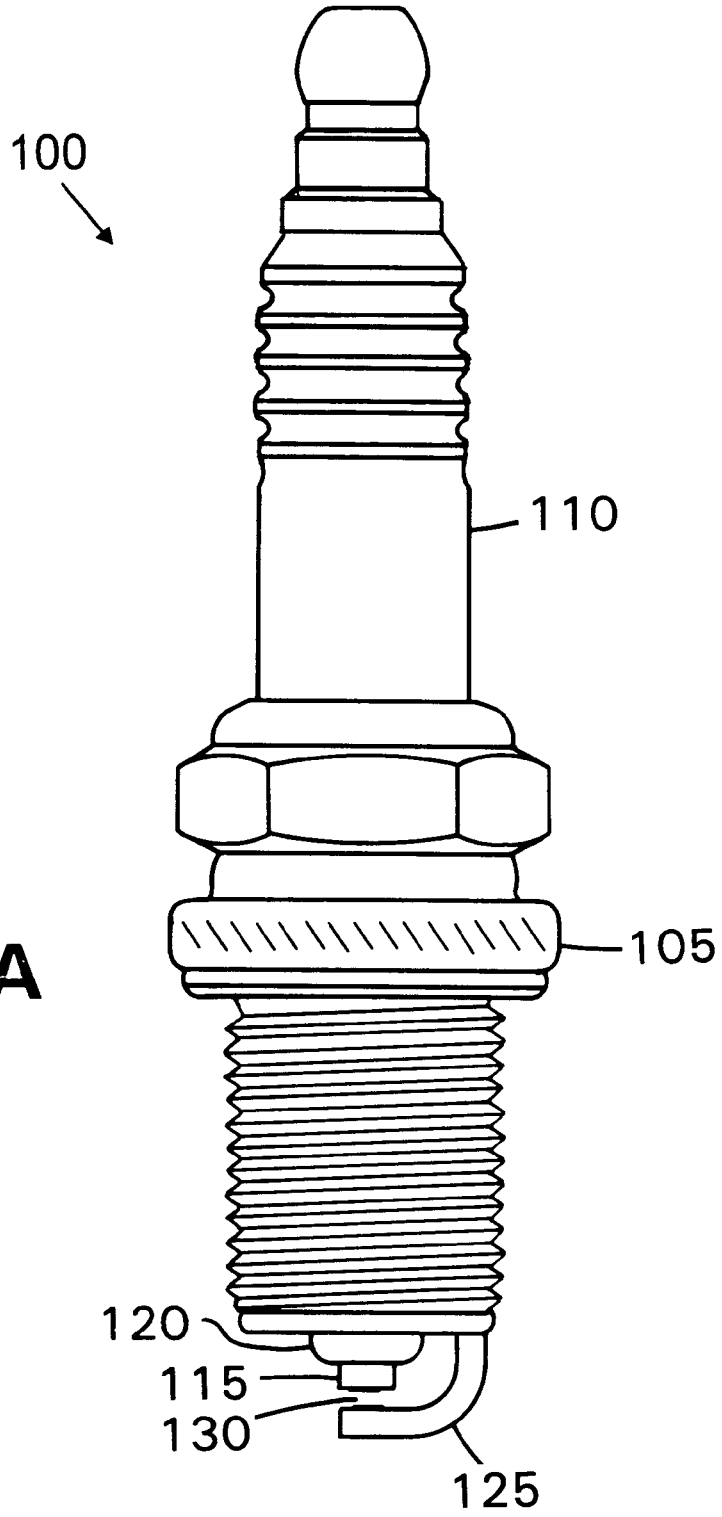
FIG. 1A is a front view of a spark plug.

Referring to FIG. 1A, a spark plug 100 includes an outer shell 105, an insulator core 110, a firing center electrode 115 extending from an insulator core nose 120, and a ground electrode 125 extending from the outer shell. The firing center electrode 115 and ground electrode 125 define a spark gap 130.

Figure 1B:
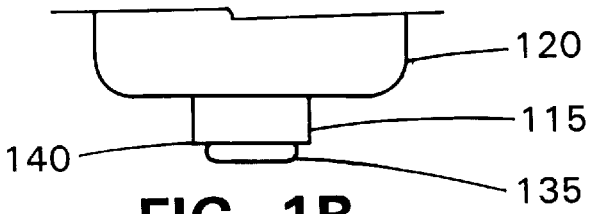
FIG. 1B is a front view of the firing center electrode of the spark plug of FIG. 1A.
Figure 1C:
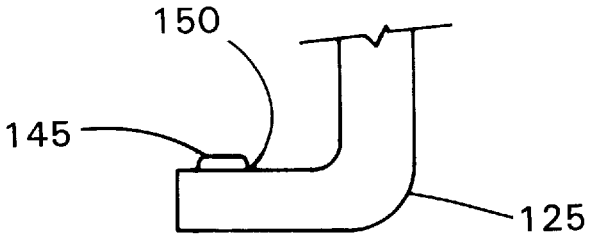
FIG. 1C is a front view of the ground electrode of the spark plug of FIG. 1A.

Referring to FIGS. 1B and 1C, the firing center electrode 115 has a precious metal outer layer 135 applied to an electrode surface 140. Similarly, the ground electrode 125 has a precious metal outer layer 145 applied to an electrode surface 150. The spark gap 130 is defined between the precious metal layers 135 and 145. This increases the quality of the spark over the life of the spark plug because the precious metal surfaces are very resistant to spark erosion. The precious metal composition may include, for example, platinum, gold, iridium, osmium, palladium, rhodium, rhenium, ruthenium, or tungsten, or an alloy of one or more of these metals. The alloy also may include nickel. For example, the alloy may be approximately 90% platinum and 10% nickel.

Figure 3A:
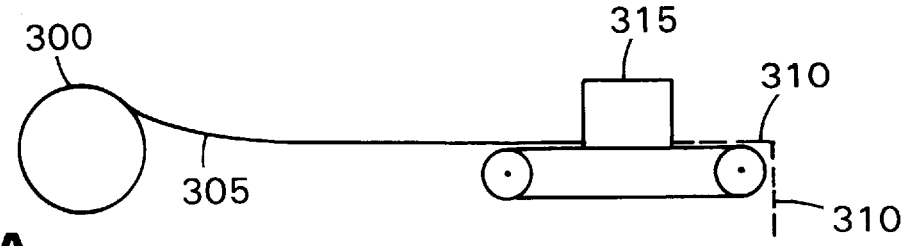
FIG. 3A is a side view illustrating cutting a wire.
Figure 2:
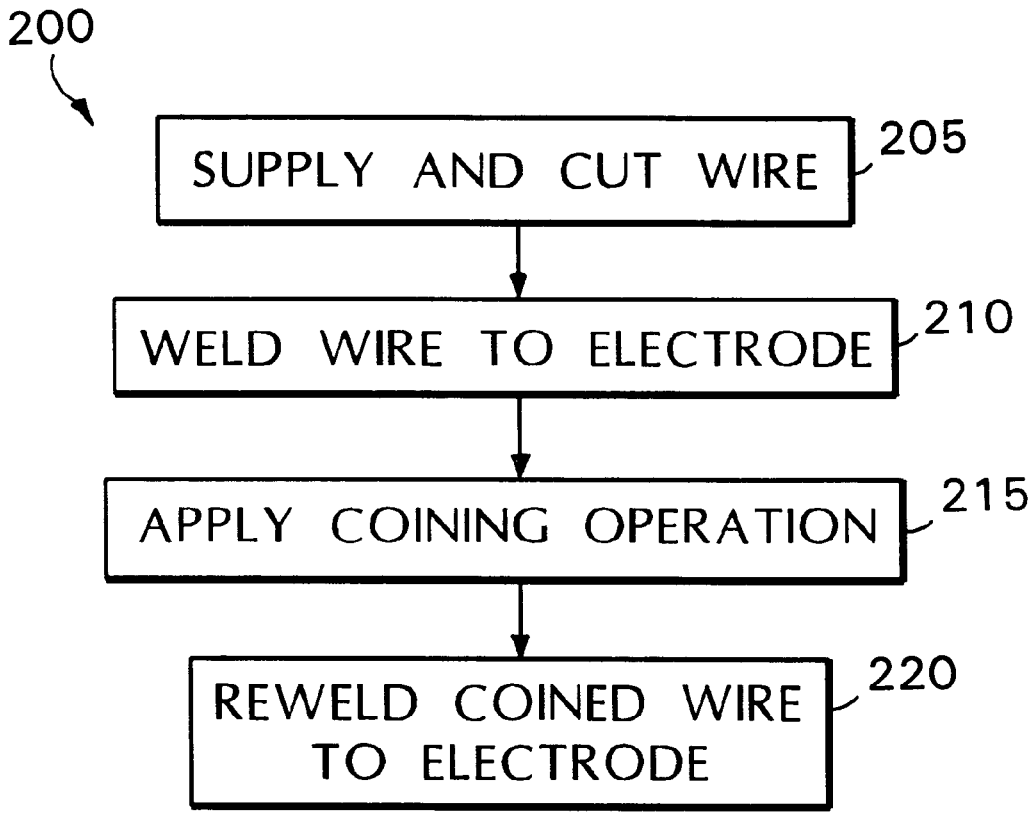
FIG. 2 is a flow chart illustrating the process of applying a precious metal to a spark plug electrode.

Referring to FIG. 2, the outer layer 135 of the precious metal on the firing electrode 115 is formed by a multistep process 200. Referring also to FIG. 3A, the precious metal is supplied in the form of a spool 300 of wire 305. The wire 305 is spooled off of the spool 300 and cut into short segments or columns 310 by a cutting apparatus 315 (step 205). The column is characterized as being generally cylindrical and having a length edge 312 and a pair of ends 313. The length of the column, measured along length edge 312, is approximately equal to the diameter of the ends 313 of the column. For example, the diameter may be in a range of 0.025 inches to 0.030 inches and the length may be in a range of 0.030 inches to 0.050 inches.

Figure 3F:
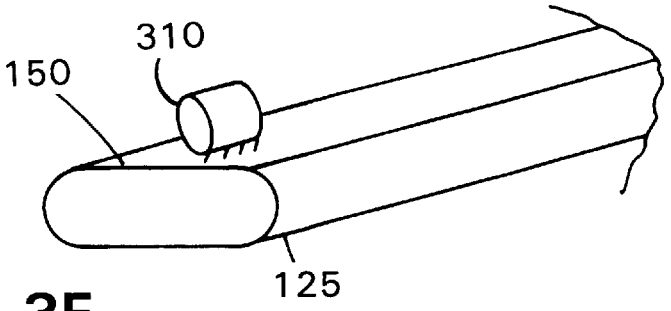
FIG. 3F is a perspective view of a column on a ground electrode.
Figure 3B:
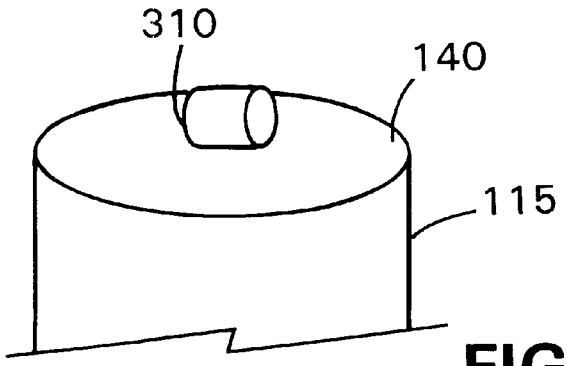
FIG. 3B is a perspective view illustrating placing a wire on an electrode.
Figure 3C:
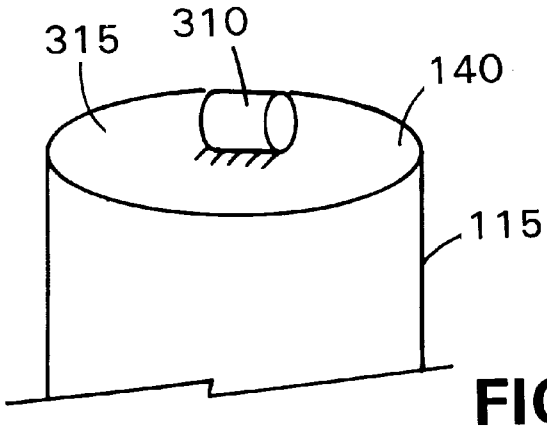
FIG. 3C is a perspective view of welding a wire on an electrode.

As shown in FIG. 3B, the column 310 is placed on the electrode surface 140 (step 210) such that the column rests on length edge 312 rather than on one of ends 313. The column is then resistance welded to the electrode surface 140 (step 215). As illustrated in FIG. 3C, the column does not entirely melt. Only a portion 315 along the length edge 312 of the column melts and affixes to the electrode surface 140.

Resistance welding attaches the column to the electrode with strength sufficient to keep the column 310 affixed to the electrode during additional manufacturing steps. In resistance welding, an electric current applied to the column 310 passes through the column edge to the electrode through the surfaces at which the electrode and column are in contact. The electric current heats the area of contact sufficiently to melt the portion 315 of the column to bond the column to the electrode. Resistance welding is known to include a squeezing period in which force is applied to squeeze the elements together with no welding current applied, an up slope period in which the welding current is initiated, a welding period in which the full welding current is applied, a down slope period in which the welding current is reduced, and a holding period in which force is applied without current.

Certain processing parameters must be specified to resistance weld two objects together. Experiments have demonstrated that the following processing parameters can be used to successfully resistance weld the column 310 to the electrode surface. For example, 34 pounds of force should be applied in the squeezing period, which lasts 500 ms. A high frequency direct current (DC) of 700 amperes should be applied in the up slope period, which lasts 8 ms. A high frequency DC current of 1100 amperes should be applied in the weld period, which lasts 16 ms. A high frequency DC current of 700 amperes should be applied in the down slope period, which lasts 8 ms. No current is applied during the holding period of 100 ms, during which force continues to be applied to the welded column 310. The welding apparatus may be a Rivet Load/Weld model with an EBA 1.5 weld head. Such a welding apparatus is available from the Taylor-Winfield Corporation of Brookefield, Ohio.

Figure 3D:
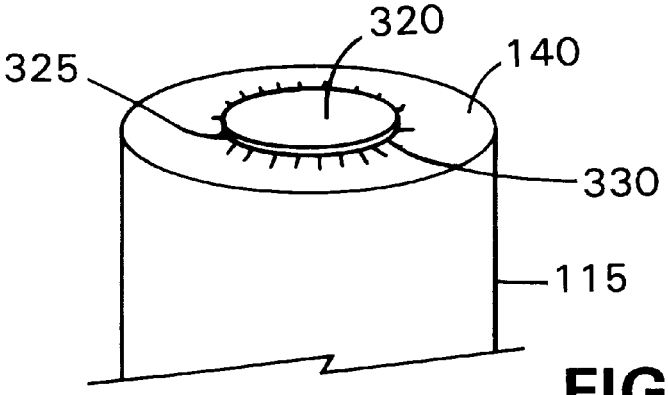
FIG. 3D is a perspective view of coining a wire welded to an electrode.

Referring also to FIG. 3D, the column 310 is coined (step 220) to form a coined column 320. Coining involves application of a compressive force that flattens the column against the electrode. The force may be approximately 400 pounds and may be created using a Center Post Welder available from Taylor-Winfield Corporation of Brookefield, Ohio. Although a majority 325 of the circumference of the coined column 320 may be firmly affixed, a portion 330 of the circumference may not be firmly affixed.

Figure 3E:
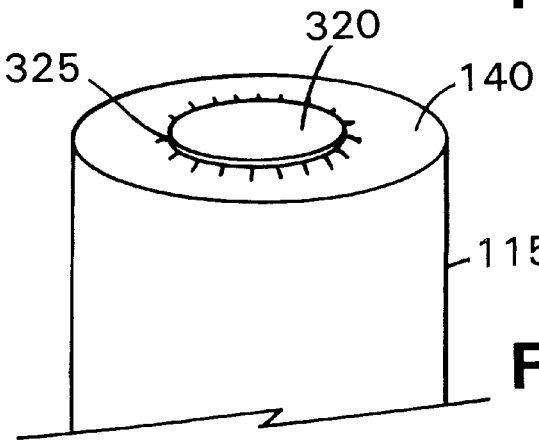
FIG. 3E is a perspective view of rewelding a wire coined on an electrode.

Referring also FIG. 3E, the coined column 325 is rewelded using resistance welding to firmly attach any portion 330 of the coined column 325 that may have become loose during the coining step or was never firmly affixed (step 225). During rewelding, the process parameters are varied from those applied during the initial resistance welding (step 215). Experiments have demonstrated that the following parameters can be used to successfully reweld the coined column 325 to the electrode surface 140. For example, 40 pounds of force should be applied in the squeezing period, which lasts 30 cycles (1 cycle=16.67 ms). During the up slope and weld periods, a tap 4 is used on the Center Post Welder. The tap 4 refers to the number of windings in the transformer. During the up slope period, which lasts 3 cycles, 40 percent of the maximum tap is used. During the weld period, which lasts 2 cycles, 85 percent of the maximum tap is used, which result in an average current of 1410 volts. In the rewelding (step 225), there is no down slope period. The hold period follows the weld period, and lasts 30 cycles.

The rewelding apparatus may be a Center Post Welder made by the Taylor-Winfield Corporation of Brookefield, Ohio. It may be fitted with an EBA 1.5 head.

Following rewelding, the electrode 115 is installed in the insulator 110 of the spark plug 100 (step 230).

Although the above description was directed to a firing center electrode 115, the method of applying the precious metal layer to a ground electrode 125 is similar. The only difference is in the orientation of the electrode in relation to the column 310. Referring FIG. 3F, rather than placing the column 310 on the electrode surface at the end of the electrode, the column is placed on the flat electrode surface 150 on the side of the electrode 125.

Figure 4A:
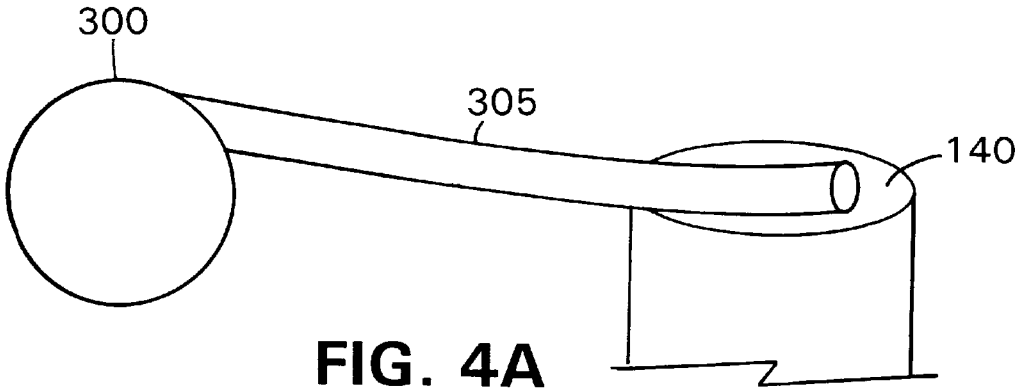
FIG. 4A is a perspective view of a wire placement on an electrode.
Figure 4B:
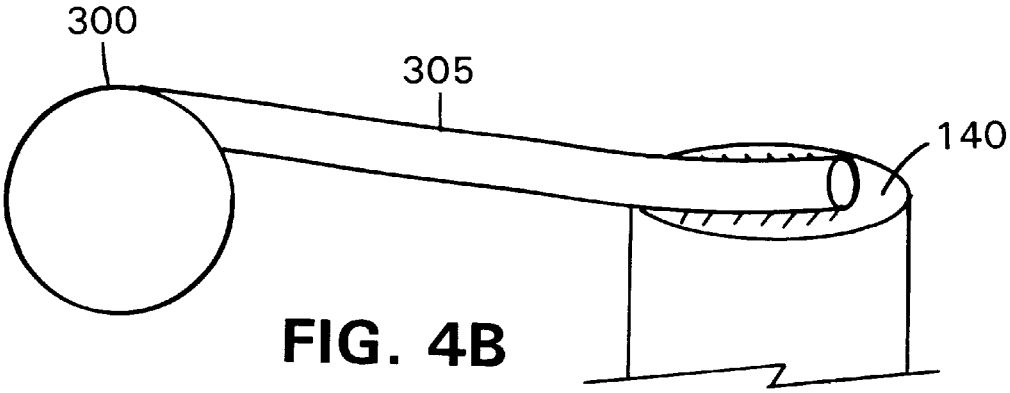
FIG. 4B is a perspective view of a resistance welding process.
Figure 4C:
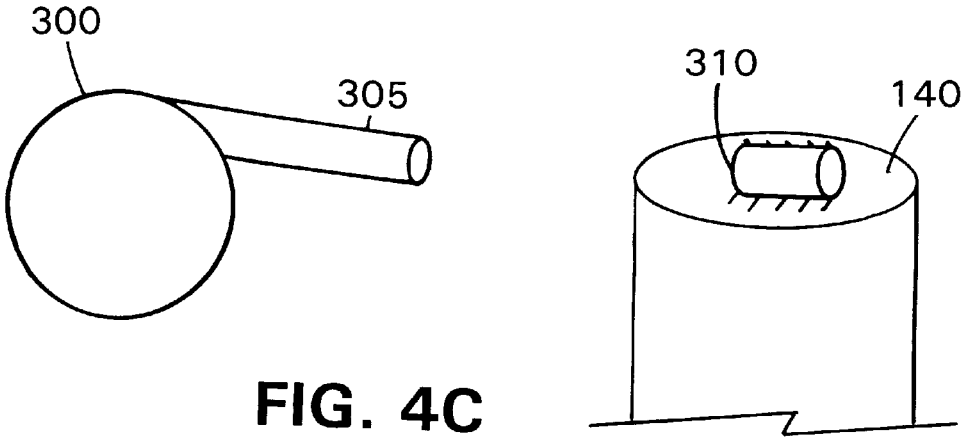
FIG. 4C is a perspective view of a cutting process.

Referring to FIGS. 4A–4C, in another implementation, the first three processing steps (i.e., 205–215) are combined. The wire 305 is spooled off of the spool 300, placed on its length edge 312 on the electrode surface 140, and resistance welded. Following affixation, the wire is cut so as to leave the column 310 attached to the electrode surface 140. The column and electrode are processed further in a manner identical to the implementation described above. Namely, the column 310 is coined and rewelded.

In another implementation, the column 310 is cut from a wire 305, placed on its length edge 312 on the electrode surface 140, and resistance welded to affix the column to the electrode surface. Following affixation, the electrode 115 is installed in the spark plug 100 without the additional process steps of coining and rewelding. In a further variation, the wire may be spooled off the spool, placed on its length edge onto the electrode surface, resistance welded, and cut.

Other implementations are within the scope of the following claims.

What is claimed is:

1. A method of affixing a precious metal to an electrode comprising:

placing a length edge of a generally cylindrical, precious metal wire on a substantially planar electrode surface; and resistance welding the wire to the substantially planar electrode surface.

2. The method of claim 1, further comprising applying a compressive force to the wire to coin the wire to the electrode surface.

3. The method of claim 2, further comprising rewelding the coined wire to the electrode surface.

4. The method of claim 1, further comprising cutting the wire after resistance welding the wire to the electrode surface.

5. The method of claim 1, further comprising cutting the wire after placing the wire on the electrode surface.

6. The method of claim 1, further comprising cutting the wire before placing the wire on the electrode surface.

7. The method of claim 6, wherein the wire placed on the electrode surface on its length edge is in the form of a column.

8. The method of claim 7, wherein the diameter of the column is approximately the same as the length of the column.

9. The method of claim 1, wherein the precious metal comprises platinum.

10. The method of claim 1, wherein the precious metal comprises an alloy of nickel and a precious metal.

11. The method of claim 1, wherein the alloy comprises an alloy of nickel and platinum.

12. The method of claim 1, wherein the wire is resistance welded to the electrode surface using an average electric current of approximately 860 amperes.

13. The method of claim 2, wherein the wire is coined to the electrode surface using a compressive force of approximately 400 pounds.

14. The method of claim 3, wherein the coined wire is rewelded using an average electric current of approximately 1410 amperes.

15. An electrode made by the method of claim 1.

16. An electrode made by the method of claim 2.

17. A method of affixing a precious metal to a spark plug electrode comprising:

cutting a generally cylindrical, precious metal wire;

placing a length edge of the cut wire on a substantially planar electrode surface;

resistance welding the cut wire to the substantially planar electrode surface;

applying a compressive force to the wire to coin the wire to the substantially planar electrode surface; and rewelding the coined wire to the substantially planar electrode surface, wherein the wire placed on its length edge on the substantially planar electrode surface is in the form of a column and the precious metal comprises platinum.

18. A spark plug having a precious metal electrode surface, the spark plug comprising:

an outer shell;

an insulator;

a firing electrode;

a ground electrode; and a precious metal surface affixed to a substantially planar electrode surface by placing a length edge of a cylindrical, precious metal wire on the substantially planar electrodes surface and resistance welding the wire to the substantially planar electrode surface.

19. The spark plug of claim 18, wherein the wire is coined to the electrode surface and resistance rewelded.

20. The spark plug of claim 18, wherein the wire placed on the electrode surface on its length edge is in the form of a column.

21. The spark plug of claim 20, wherein the diameter of the column is approximately the same as the length of the column.

22. The spark plug of claim 18, wherein the precious metal comprises platinum.

23. The spark plug of claim 18, wherein the precious metal comprises an alloy of nickel and a precious metal.

24. The spark plug of claim 23, wherein the alloy comprises an alloy of nickel and platinum.

* * * * *

UNITED STATES PATENT AND TRADEMARK OFFICE

CERTIFICATE OF CORRECTION

PATENT NO. : 6,132,277
DATED : October 17, 2000
INVENTOR(S) : Daniel Lee Tribble, Michael Earl Garrett, Robert Scott Ingham and Timothy George Timko It is certified that error appears in the above-identified patent and that said Letters Patent is hereby corrected as shown below:

Column 4,
Line 49, delete "an" and insert therefor -- a spark plug --.

Column 6,
Line 16, "electrodes" and insert therefor -- electrode --.

Signed and Sealed this

Fourteenth Day of May, 2002

*Attest:*

*Attesting Officer*

JAMES E. ROGAN
*Director of the United States Patent and Trademark Office*